US010415120B2

(12) United States Patent
Konyashin et al.

(10) Patent No.: US 10,415,120 B2
(45) Date of Patent: Sep. 17, 2019

(54) CEMENTED CARBIDE MATERIAL AND RELATED PRODUCING METHOD

(71) Applicant: ELEMENT SIX GMBH, Burghaun (DE)

(72) Inventors: Igor Yurievich Konyashin, Burghaun (DE); Bernd Heinrich Ries, Burghaun (DE)

(73) Assignee: Element Six GmbH, Burghaun (DE)

( * ) Notice: Subject to any disclaimer, the term of this patent is extended or adjusted under 35 U.S.C. 154(b) by 0 days.

(21) Appl. No.: 15/763,912

(22) PCT Filed: Sep. 28, 2016

(86) PCT No.: PCT/EP2016/073071
§ 371 (c)(1),
(2) Date: Mar. 28, 2018

(87) PCT Pub. No.: WO2017/055332
PCT Pub. Date: Apr. 6, 2017

(65) Prior Publication Data

US 2018/0274065 A1 Sep. 27, 2018

(30) Foreign Application Priority Data

Oct. 2, 2015 (GB) ..... 1517442.8

(51) Int. Cl.

| | |
|---|---|
| ***C22C 29/08*** | (2006.01) |
| ***B22F 7/08*** | (2006.01) |
| ***C22C 29/06*** | (2006.01) |
| ***B22F 3/16*** | (2006.01) |
| ***B22F 3/24*** | (2006.01) |
| ***C22C 1/05*** | (2006.01) |
| *B22F 5/00* | (2006.01) |

(52) U.S. Cl.
CPC ..... *C22C 29/08* (2013.01); *B22F 3/16* (2013.01); *B22F 3/24* (2013.01); *B22F 7/08* (2013.01); *C22C 1/051* (2013.01); *C22C 29/067* (2013.01); *B22F 2003/248* (2013.01); *B22F 2005/001* (2013.01); *B22F 2301/15* (2013.01); *B22F 2302/10* (2013.01); *B22F 2304/10* (2013.01); *C22C 2202/02* (2013.01)

(58) Field of Classification Search
CPC ..... B22F 2003/248; B22F 2005/001; B22F 2301/15; B22F 2302/10; B22F 2304/10; B22F 3/16; B22F 3/24; B22F 7/08; C22C 1/051; C22C 2202/02; C22C 29/067; C22C 29/08
See application file for complete search history.

(56) References Cited

U.S. PATENT DOCUMENTS

| | | | | |
|---|---|---|---|---|
| 6,126,709 | A | 10/2000 | Akerman et al. | |
| 6,238,148 | B1 | 5/2001 | Taniuchi et al. | |
| 9,314,847 | B2 * | 4/2016 | Konyashin ..... | B22F 3/24 |

FOREIGN PATENT DOCUMENTS

| | | | |
|---|---|---|---|
| CN | 101760685 | A | 6/2010 |
| EP | 0819777 | A1 | 1/1998 |
| GB | 2489583 | A | 10/2012 |
| WO | 2012130851 | A1 | 10/2012 |

OTHER PUBLICATIONS

Konyashin, Igor, "Cemented Carbides for Mining, Construction and Wear Parts," Comprehensive Hard Materials, Elsevier Science and Technology, 2014, pp. 425-451, Elsevier Ltd.
Konyashin, I., et al., "Novel ultra-coarse hardmetal grades with reinforced binder for mining and construction," Int. Journal of Refractory Metals & Hard Materials, 2005, pp. 225-232, vol. 23, Elsevier Ltd.
Konyashin, I., et al., "On the mechanism of WC coarsening in WC-Co hardmetals with various carbon contents," Int. Journal of Refractory Metals & Hard Materials, 2009, pp. 234-243, vol. 27, Elsevier Ltd.
Mingard, K. P., et al., "Comparison of EBSD and conventional methods of grain size measurement of hardmetals," Int. Journal of Refractory Metals & Hard Materials, 2009, pp. 213-223, vol. 27, Elsevier Ltd.
United Kingdom Patent Application No. GB1517442.8, Combined Search and Examination Report dated Jun. 16, 2016, 6 pages.
United Kingdom Patent Application No. GB1616419.6, Combined Search and Examination Report dated Nov. 15, 2016, 7 pages.
International Patent Application No. PCT/EP2016/073071, International Search Report and Written Opinion dated Dec. 22, 2016, 16 pages.
United Kingdom Patent Application No. GB1616419.6, Intention to Grant dated Nov. 7, 2017, 2 pages.
United Kingdom Patent Application No. GB1616419.6, Notification of Grant dated Dec. 18, 2017, 2 pages.

* cited by examiner

*Primary Examiner* — Jenny R Wu
(74) *Attorney, Agent, or Firm* — Dean W. Russell; Clark F. Weight; Kilpatrick Townsend & Stockton LLP

(57) ABSTRACT

A cemented carbide material comprising tungsten carbide grains, the content of tungsten carbide in the cemented carbide material being at least 75 weight percent and at most 95 weight percent. The cemented carbide material comprises a binder phase comprising any of cobalt, iron, or nickel, and nanoparticles. The nanoparticles include material according to the formula $Co_xW_yC_z$, where x is a value in the range from 1 to 7, y is a value in the range from 1 to 10 and z is a value in the range from 0 to 4. The nanoparticles have a mean grain size of no more than 10 nm and at least 10 percent of the nanoparticles have a size of at most 5 nm. The volume percent of the tungsten carbide grains having a grain size of no more than 1 μm is less than 4 percent. A method for producing the cemented carbide material is also disclosed.

16 Claims, 3 Drawing Sheets

CEMENTED CARBIDE MATERIAL AND RELATED PRODUCING METHOD

FIELD OF THE INVENTION

This disclosure relates generally to cemented carbide material and tools comprising the same.

BACKGROUND

Cemented carbide material comprises particles of metal carbide such as tungsten carbide (WC) or titanium carbide (TiC) dispersed within a binder material comprising a metal such as cobalt (Co), nickel (Ni) or metal alloy. The binder phase may be said to cement the carbide particles together as a sintered compact. Measurements of magnetic properties may be used to measure indirectly aspects of the microstructure and properties of cemented carbide materials. The magnetic coercive force (or simply coercive force or coercivity) and magnetic moment (or magnetic saturation) can be used for such purposes.

Cemented carbides have a relatively high fracture toughness and hardness, and so are used in tools that exploit these properties. Examples of such tools include picks for road planing or mining applications. However, the hardness and wear-resistance of WC—Co cemented carbides usually can be improved only at the expense of fracture toughness and strength (Konyashin, "Cemented Carbides for Mining, Construction and Wear Parts", Comprehensive Hard Materials, Elsevier Science and Technology, 2014). It is therefore difficult to simultaneously improve hardness, wear-resistance, fracture toughness and transverse rupture strength (TRS) of cemented carbide materials.

One possible approach to improve both the hardness and fracture toughness is the fabrication of cemented carbides with a uniform microstructure containing rounded WC grains. U.S. Pat. No. 6,126,709 discloses such a cemented carbide material, in which the microstructure is coarse and very uniform containing large rounded WC grains. A disadvantage of this material is the presence of very thick Co interlayers around the large, rounded WC grains. The thick Co interlayers are characterized by low hardness and wear-resistance and therefore tools using this type of material quickly become worn during rock-cutting or rock-drilling operations. This leaves unsupported WC grains, which can be easily cracked, destroyed and detached resulting in high wear rates (Konyashin et. al., "Novel Ultra-Coarse Hardmetal Grades with Reinforced Binder for Mining and Construction", International Journal of Refractory Metals and Hard Materials, 23(2005)225-232).

One approach to mitigate the low wear-resistance of thick Co interlayers in ultra-coarse WC—Co materials mentioned above is suggested in WO2012/130851A1. This discloses a cemented carbide material in which the binder interlayers are hardened and reinforced by nanoparticles having a composition according to the formula $Co_xW_yC_z$. The cemented carbide material disclosed in WO2012/130851A1 is characterized by a very low carbon content and consequently low magnetic moment, which is known to lead to the suppression or complete elimination of the dissolution and the re-crystallization of fine-grain WC fraction usually present in initial WC powders during liquid-phase sintering (see Konyashin et. al., "On the Mechanism of WC Coarsening in WC—Co Hardmetals with Various Carbon Contents", International Journal of Refractory Metals and Hard Materials, 27 (2009) 234-243). As a result, the microstructure of the cemented carbides disclosed in WO2012/130851A1 is characterized by relatively low uniformity and contains much of the fine-grain WC fraction present in the original ultra-coarse WC powder, which leads to their reduced fracture toughness.

SUMMARY

It is an object to provide a cemented carbide material with an improved fracture toughness and hardness.

According to a first aspect, there is provided a cemented carbide material comprising tungsten carbide grains, the content of tungsten carbide in the cemented carbide material being at least 75 weight percent and at most 95 weight percent. The cemented carbide material also comprises a binder phase comprising any of cobalt, iron, or nickel, the binder phase further comprising nanoparticles, the nanoparticles comprising material according to the formula $Co_xW_yC_z$, where x is a value in the range from 1 to 7, y is a value in the range from 1 to 10 and z is a value in the range from 0 to 4. The nanoparticles have a mean grain size of no more than 10 nm and at least 10 percent of the nanoparticles have a size of at most 5 nm. The volume percent of the tungsten carbide grains having a grain size of no more than 1 μm is less than 4 percent. An advantage of having a negligible amount of tungsten carbide grains with a grain size of no more than 1 μm is that fracture toughness is improved without a significant reduction in hardness and wear resistance.

As an option the tungsten carbide mean grain size is 4±2 μm.

The volume percentage of tungsten carbide grains larger than 8 μm is optionally below 10 percent.

As an option the binder material further comprises at least 10 weight percent tungsten.

As an option the cemented carbide material has a cobalt content between 5 and 8 weight percent, and the cemented carbide material has a magnetic coercive force Hc (in kA/m) of at least $Hc=-1.9D+12$, where the D value is in microns and obtained by the circle equivalent diameter method on the basis of EBSD mapping images.

As an alternative option, the cemented carbide material has a cobalt content between 8 and 12 weight percent and the cemented carbide material has a magnetic coercive force Hc (in kA/m) of at least $Hc=-2.1D+12$, where the D value is in microns and obtained by the circle equivalent diameter method on the basis of EBSD mapping images.

The tungsten carbide particles optionally have a mean size D of at least 4 microns and the cemented carbide material has a magnetic coercive force Hc (in kA/m) of at least about $1.1\times(100\times[Co])-1.2/D+3.3)$, where D is in microns, and [Co] is the weight percent of cobalt in the cemented carbide material.

As an alternative option, the tungsten carbide particles have a mean size D of less than 4 microns and the cemented carbide material has a magnetic coercive force Hc (in kA/m) of at least about $1.1\times(200\times[Co])-1.2/D+3.3)$, where D is in microns, and [Co] is the weight percent of cobalt in the cemented carbide material.

The cemented carbide material optionally comprises at least 0.1 weight percent to 10 weight percent of any of vanadium, chromium, tantalum, titanium, molybdenum, niobium and hafnium.

According to a second aspect, there is provided a method of making a cemented carbide body. The method comprises:

providing a de-agglomerated tungsten carbide powder in which less than 4 volume percent of tungsten carbide has a grain size of less than 1 μm;

milling the tungsten carbide powder and a binder precursor powder together;

pressing the milled powders to form a green body;

sintering the green body to form a sintered body comprising tungsten carbide and a binder phase; and heat treating the sintered body at a temperature in a range of 500° C. to 900° C. for a period of time; the period in hours being at least (0.8×D)−0.15 and at most about (4.3×D)−1.7, where D is the mean size of WC in microns; and wherein the sintered body comprises less than 4 volume percent of tungsten carbide having a grain size less than 1 μm.

As an option the binder phase comprises at least 10 weight percent tungsten. As a further option, the tungsten is present in the binder phase in the form of a solid solution or dispersed particles comprising a compound according to the formula $Co_xW_yC_z$, where x is a value in the range from 1 to 7, y is a value in the range from 1 to 10 and z is a value in the range from 1 to 4.

The binder phase optionally comprises any of iron or nickel.

As an option, the composition and microstructure of the sintered body is selected such that the magnetic moment (or magnetic saturation) of the sintered body is at least about 70 percent and at most about 85 percent of the theoretical value of binder material comprising nominally pure Co or an alloy of Co and Ni comprised in the binder material.

As an option, the method comprises de-agglomerating tungsten carbide powder and sifting the tungsten carbide to provide a tungsten carbide powder in which less than 4 volume percent of tungsten carbide has a grain size of less than 1 μm.

According to a third aspect, there is provided a tool comprising cemented carbide material as described above in the first aspect.

As an option, the tool is any of a pick for road-planing and a pick for mining.

As an option, the tool comprises a superhard tip joined to a support body comprising cemented carbide material as described above in the first aspect.

BRIEF DESCRIPTION OF THE DRAWINGS

Non-limiting example arrangements to illustrate the present disclosure are described with reference to the accompanying drawings, in which.

DETAILED DESCRIPTION

Figure 1:
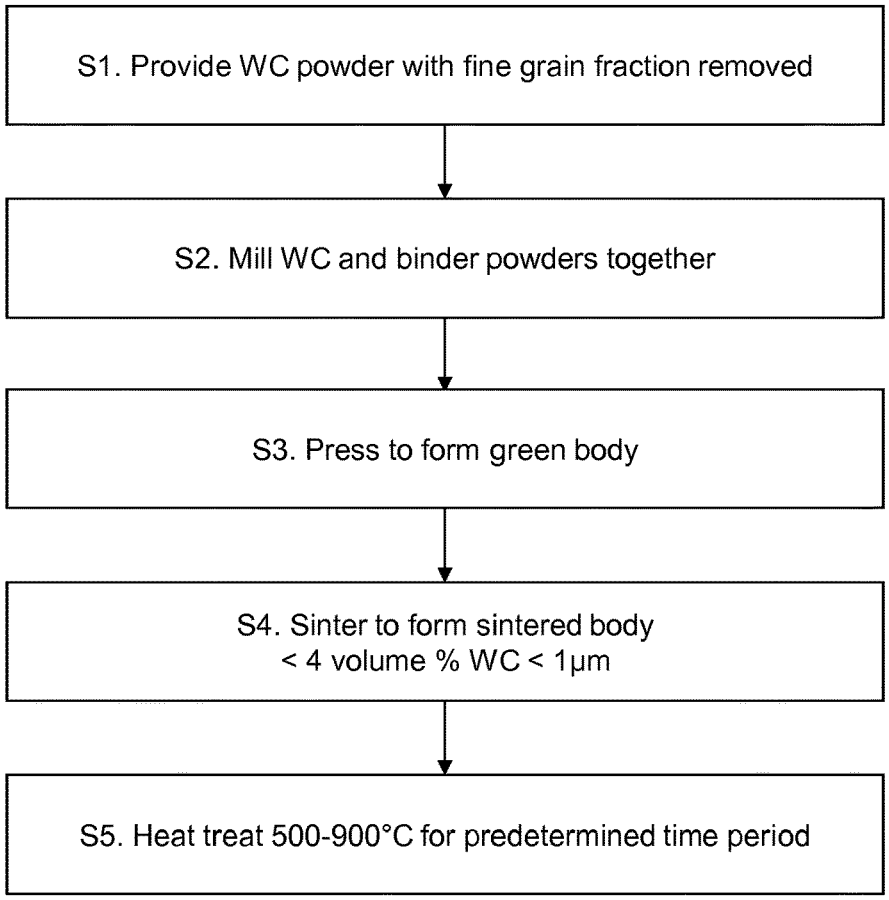
FIG. 1 is a flow diagram showing exemplary steps.

As used herein in relation to grains or particles such as WC grains comprised in hard-metal material, the term "grain size" D refers to the sizes of the grains measured as follows. A surface of a body comprising the hard-metal material is prepared by polishing for investigation by means of electron backscatter diffraction (EBSD) and EBSD images of the surface are obtained by means of a high-resolution scanning electron microscope (HRSEM). Images of the surface in which the individual grains can be discerned are produced by this method and can be further analysed to provide the number distribution of the grains by size, for example. As used herein, no correction (e.g. Saltykov correction) is applied to correct the grain sizes to account for the fact that they were obtained from a two dimensional image in this way. The grain size is expressed in terms of equivalent circle diameter (ECD) according to the ISO FDIS 13067 standard. The ECD is obtained by measuring of the area A of individual grains exposed at the surface and calculating the diameter of a circle that would have the same area A, according to the equation D=square root of (4A/π). The method is described further in section 3.3.2 of ISO FDIS 13067 entitled "Microbeam analysis—Electron Backscatter Diffraction—Measurement of average grain size" (International Standards Organisation, Geneva, Switzerland, 2011). The mean grain size D of WC grains in cemented WC material is obtained by calculating the number average of the WC grain sizes D as obtained from the EBSD images of the surface. The EBSD method of measuring the sizes of the grains has the advantage that each individual grain can be discerned, in contrast to certain other methods in which it may be difficult or impossible to discern individual grains from agglomerations of grains. In other words, certain other methods may be likely to give false higher values for grain size measurements (see e.g.: K. P. Mingard, B. Roebuck a, E. G. Bennett, M. G. Gee, H. Nordenstrom, G. Sweetman, P. Chan. Comparison of EBSD and conventional methods of grain size measurement of hard metals. Int. Journal of Refractory Metals & Hard Materials 27 (2009) 213-223).

The amount of tungsten dissolved in cobalt-based binder material can be measured indirectly, by measurement of magnetic moment (or magnetic saturation) of cemented carbides because the magnetic saturation of Co decreases in inverse proportion to the content of tungsten in solution. The concentration of tungsten dissolved in the binder tends to be higher, the lower the total carbon content, so that the magnetic moment shows indirectly the total carbon content in cemented carbides. The magnetic saturation Ms is directly proportional to [C]/[W]×[Co]×201.9 in units of $\mu T \cdot m^3/kg$, where [W] and [C] are the concentrations of W and C, respectively, in the binder material and [Co] is the weight percent of Co in the cemented carbide material, which can be measured by Auger electron spectroscopy (AES). For example, the W concentration at low C contents is significantly higher. The magnetic saturation of a hard metal, of which cemented tungsten carbide is an example, is defined as the magnetic moment per unit weight, σ, as well as the induction of saturation per unit weight, 4πσ. The magnetic moment, σ, of pure Co is 16.1 micro-Tesla times cubic meter per kilogram ($\mu T \cdot m^3/kg$), and the magnetic saturation, 4πσ, of pure Co is 201.9 $\mu T \cdot m^3/kg$.

The content of Co in the binder material of cemented carbide material can be measured by various methods well known in the art, including indirect methods such as the magnetic properties of the cemented carbide material or more directly by means of energy-dispersive X-ray spectroscopy (EDX), or the most accurate method is based on chemical leaching of Co.

It has been surprisingly found out that if cemented carbide materials with coarse and rounded WC grains comprising thick binder interlayers, which are hardened and reinforced by nanoparticles, have a uniform microstructure that includes little or no fine-grain WC fraction, their fracture toughness is significantly improved. This can be achieved almost without sacrificing hardness and consequently wear-resistance.

One way to reduce the fine-grain WC fraction is to de-agglomerate the starting ultra-coarse WC powder with the consequent separation of the fine-grain WC fraction by sifting or other methods.

FIG. 1 is a flow diagram showing exemplary steps, in which the following numbering corresponds to that of FIG. 1.

S1. Remove fine grain fraction less than 1 micron in size from de-agglomerated WC powder, for example by sifting.

S2. Mill WC and binder precursor powders together. Examples of binder precursor powders include cobalt, iron, nickel and alloys thereof. Ball milling is an example of the type of milling that may be employed.

S3. The milled powders are dried and subsequently compacted to form a green body.

S4. The green body is sintered at a temperature in the range from about 1350° C. to about 1500° C. The sintering may include steps such as vacuum sintering and hot isostatic pressure (HIP) in an inert atmosphere. The resultant sintered body has less than 4 volume percent of WC grains with a grain size of no more than 1 μm.

S5. The sintered body may be heat treated at 500-900° C. for a predetermined time period, the time period in hours being at least (0.8D)−0.15 and at most about (4.3D)−1.7, where D is the mean size of WC in microns.

By using a starting WC powder that has substantially no fine grain fraction, the final sintered body has a negligible amount of WC grains finer than 1 μm resulting in its improved fracture toughness almost without losing hardness and consequently wear-resistance.

Non-limiting examples of cemented carbide material are described in more detail below.

Example 1

Figure 2:
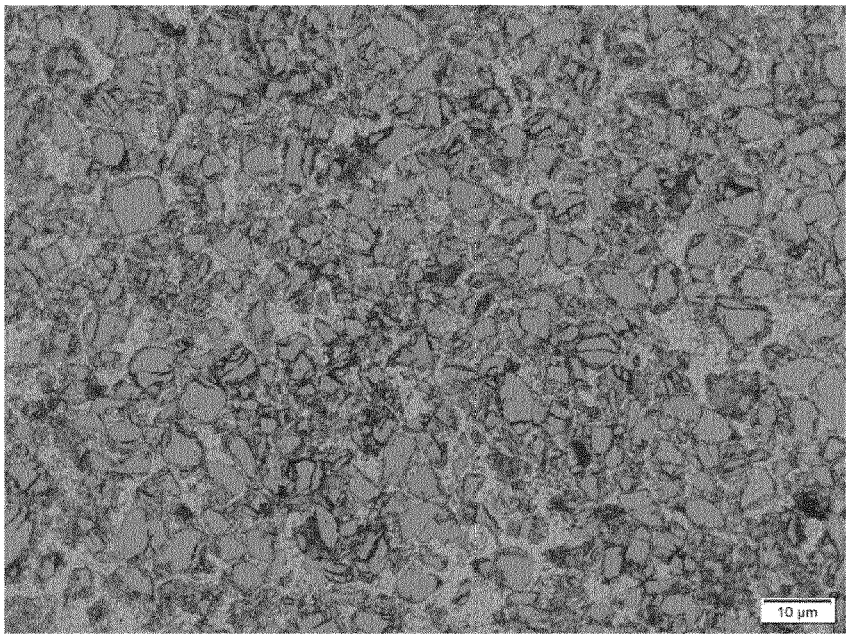
FIG. 2 is a micrograph showing sifted tungsten carbide powder embedded in a copper matrix after solid-state sintering

Ultra-coarse WC powder with mean grain size (the Fischer number) of 19.0 microns (MAS2000 from H.C.Starck™, Germany) and stoichiometric carbon content of 6.12 weight percent was de-agglomerated in a ball-mill with a powder-to-ball ratio of 1:2 in alcohol for 10 hrs. The de-agglomerated WC powder was subjected to sifting by use of the CFS 5 HD-S unit (Netzsch, Germany). As a result of sifting, the WC fraction finer than 1 μm was almost completely removed from the powder. This is shown in FIG. 2, which is a cross-section of the ultra-coarse WC powder after de-agglomeration and sifting. The WC powder was mixed with a Cu powder and sintered at 1050° C. to prepare a compact sample for the image.

The de-agglomerated and sifted WC powder was milled with about 9.7 weight percent Co powder and about 2 weight percent W metal powder. Both the W powder and the Co powder had a mean particle size of about 1 micron. The composition of the combined powders was therefore 88.3 weight percent WC (including the excess carbon), 9.7 weight percent Co and 2 weight percent W. The powders were milled together for 10 hours using a ball mill in a milling medium comprising hexane with 2 weight percent paraffin wax, using a powder-to-balls ratio of 1:3.

The milled powder was dried and green bodies for sintering bodies configured for carrying out transverse rupture strength (TRS) measurement according to the ISO 3327-1982 standard and wear-resistance measurement according to the ASTM B611-85 standard were prepared by compacting the milled powder mixture. The indentation fracture toughness was measured by the Palmqvist method at a load of 30 kgf according to the ISO/DIS 28079 standard.

The green bodies were sintered at 1420° C. for 75 minutes to produce sample sintered bodies. The sintering cycle including a 45 minute vacuum sintering stage and a 30 minute HIP sintering stage was carried out in an argon atmosphere at a pressure of 40 bars.

Metallurgical cross-sections of some of the sample bodies were made for examination of the microstructure and the Vickers hardness of the sample bodies. Transmission electron microscopy (TEM) and high-resolution TEM (HRTEM) studies of the binder were carried out on the JEOL-4000FX instrument.

The microstructure was found to comprise only WC and the binder material; no eta-phase or free carbon was found.

The mean WC grain size was determined by use of EBSD mapping of three areas on each sample followed by measurement of the area A of each grain and then converting each value of A to a circle equivalent diameter, where D is defined as the diameter of the circle with an area equivalent to the grain section area.

Figure 3:
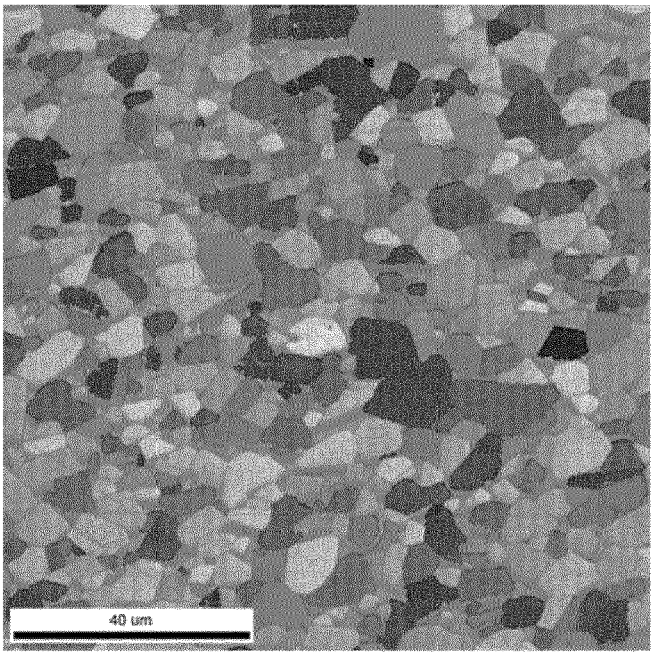
FIG. 3 is an EBSD micrograph showing a sintered cemented carbide prepared as described in Example 1.

Grain size distributions were determined for each EBSD map and the mean grain size determined as a number average. The WC mean grains size obtained by the circle equivalent diameter method on the basis of the EBSD mapping images was equal to 4.2 μm. Table 1 shows the WC grain size distribution (Dceq) obtained on the basis of the EBSD examinations and FIG. 3 shows the microstructure of a resultant cemented carbide (EBSD image). It can be seen that the cemented carbide microstructure comprises almost no WC fraction finer than 1 μm. TEM and electron diffraction images of the binder material indicated the presence of only the face-centered cubic (fcc) crystallographic structure of Co, indicating the substantial absence of nanoparticles in the binder material.

TABLE 1

| % | ≤1 μm | 1-2 μm | 2-3 μm | 3-4 μm | 4-5 μm | 5-6 μm | 6-7 μm | 7-8 μm | >8 μm |
|---|---|---|---|---|---|---|---|---|---|
| Ex 1 | 0.2 | 16.5 | 18.7 | 19.0 | 15.0 | 10.2 | 8.7 | 5.3 | 6.5 |
| Ex 2 | 1.2 | 21.3 | 18.8 | 19.8 | 11.6 | 11.4 | 8.2 | 4.2 | 3.7 |

The sample bodies were heat-treated in a vacuum at 600° C. for 10 hours, following which these samples were analyzed as described above. The appearance of the microstructure of the cemented carbide under visible light had not substantially changed.

The properties of the samples of the new cemented carbide with uniform microstructure are presented in Table 1.

A control batch of cemented carbides was made in exactly the same way as described above except that the ultra-coarse MAS2000 WC powder was not subjected to de-agglomeration and sifting, and so contained a large proportion of WC particles having a grain size of smaller than 1 μm. The control batch was found to be much finer with the WC mean grain size of 3.6 μm and contained 10.3 vol. % of WC fraction finer than 1 μm.

Table 2 shows the properties of the carbide samples of Example 1 with a uniform microstructure in comparison with those of the control batch.

TABLE 2

| Property | Example 1 | Control batch |
|---|---|---|
| Density, g/cm$^3$ | 14.60 | 14.62 |
| TRS, MPa | 3,500 | 2,700 |
| Vickers hardness (HV30), GPa | 11.0 | 11.1 |
| Magnetic coercive force, kA/m | 12.8 | 14.0 |
| Magnetic moment σ, μT m$^3$/kg, | 1.12 | 1.10 |
| Wear rate, cm$^3$/revolution. | $0.60 \times 10^{-4}$ | $0.58 \times 10^{-4}$ |
| Palmqvist fracture toughness, MPa m½. | 20.4 | 18.0 |

It can be seen from Table 2 that the control batch is characterized by nearly the same values of hardness and wear-resistance, but by significantly lower values of TRS and fracture toughness as a result of the presence of the fine-grain WC fraction in its microstructure. The absence of the fine grain WC starting powders therefore improves TRS and fracture toughness without much loss in hardness and wear resistance.

TEM and electron diffraction images of the binder material of both the new cemented carbide and the control batch indicated the presence of reflections from fcc Co and satellite reflections corresponding to the nanoparticles. A dark field TEM image of the binder material obtained using the satellite reflections indicated the presence of nanoparticles. TEM and HRTEM images indicated that the nanoparticles have a size in the range from about 0.5 to about 7 nm. The mean grain size of the nanoparticles was measured by the linear intercept method and was found to be equal to 3.1 nm and the percentage of nanoparticles having size less than 3 nm was found to be 40 percent. The nanoparticles are believed to correspond to eta- ($Co_3W_3C$ or $Co_6W_6C$) or theta-phases ($Co_2W_4C$). Although the crystal lattice of these phases is very similar, the inter-lattice constant corresponded most closely to that of the theta-phase.

Example 2

The ultra-coarse WC powder (MAS2000) was de-agglomerated and sifted in exactly the same way as in Example 1. The de-agglomerated and sifted WC powder was blended with about 6.2 weight percent Co powder and about 1.5 weight percent W metal powder. Both the W powder and the Co powder had a mean particle size of about 1 micron. The powders were milled together for 10 hours by means of a ball mill in a milling medium comprising hexane with 2 weight percent paraffin wax, using a powder-to-balls ratio of 1:3. The powder was dried and green bodies for sintering bodies configured for carrying out transverse rupture strength (TRS) measurement according to the ISO 3327-1982 standard and wear-resistance measurement according to the ASTM B611-85 standard were prepared by compacting the powder mixture. The green bodies were sintered at 1420° C. for 75 minutes to produce sample sintered bodies. The sintering cycle included a 45 minute vacuum sintering stage and a 30 minute HIP sintering stage carried out in an argon atmosphere at a pressure of 40 bars. The sintered samples were prepared and examined in the same way as described in Example 1.

The microstructure was found to comprise only WC and the binder material; no eta-phase or free carbon was found.

Figure 4:
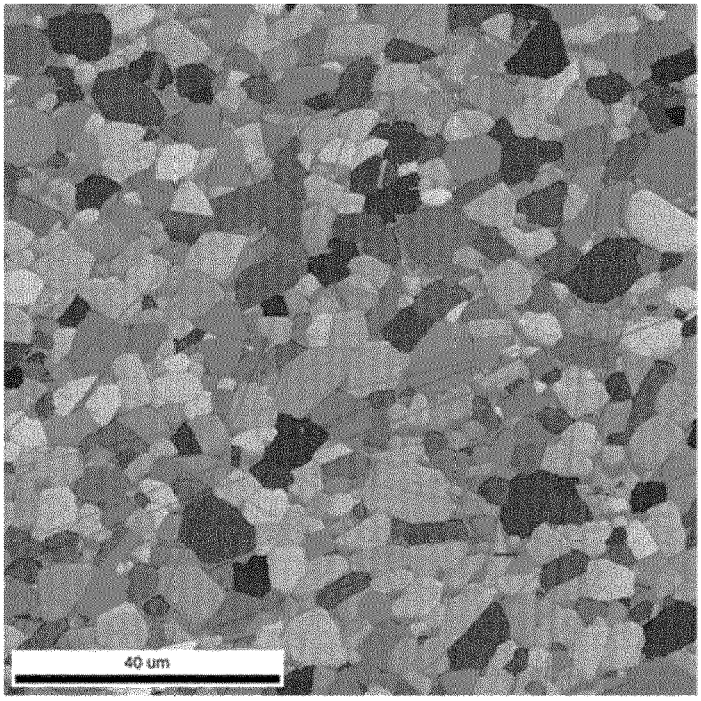
FIG. 4 is an EBSD micrograph showing a sintered cemented carbide prepared as described in Example 2.

Grain size distributions were determined for each EBSD map and the mean grain size determined as a number average. The WC mean grains size obtained by the circle equivalent diameter method on the basis of the EBSD mapping images was equal to 3.9 μm. Table 1 indicates the WC grain size distribution obtained on the basis of the EBSD examinations and FIG. 4 shows the microstructure of the cemented carbides (EBSD image). It can be seen that the cemented carbide microstructure comprises very little WC fraction finer than 1 μm. The samples were heat-treated in exactly the same way as in Example 1.

The appearance of the microstructure of the cemented carbide under visible light had not substantially changed. The TRS of the of the heat treated cemented carbide material had increased substantially to 3,800 MPa, the Vickers hardness (HV30) had increased to 11.9 GPa, the magnetic coercive force had increased substantially to 15.6 kA/m, the magnetic moment σ was 1.14 μT m$^3$/kg, and the wear rate had decreased substantially to $0.4 \times 10^{-4}$ cm$^3$/revolution. The Palmqvist fracture toughness was found to be 17.6 MPa m$^{1/2}$.

TEM images of the binder material indicated the presence of reflections from fcc Co and satellite reflections corresponding to the nanoparticles. The dark field TEM image of the binder material obtained using the satellite reflections indicated the presence of nanoparticles having size in the range from about 0.5 to about 7 nm. The mean grain size of the nanoparticles is measured by the linear intercept method and was found to be equal to 3.3 nm and the percentage of nanoparticles having size less than 3 nm was found to be 45 percent. The nanoparticles are believed to correspond to eta- ($Co_3W_3C$ or $Co_6W_6C$) or theta-phases ($Co_2W_4C$). Although the crystal lattice of these phases is very similar, the inter-lattice constant corresponded most closely to that of the theta-phase.

Figure 5:
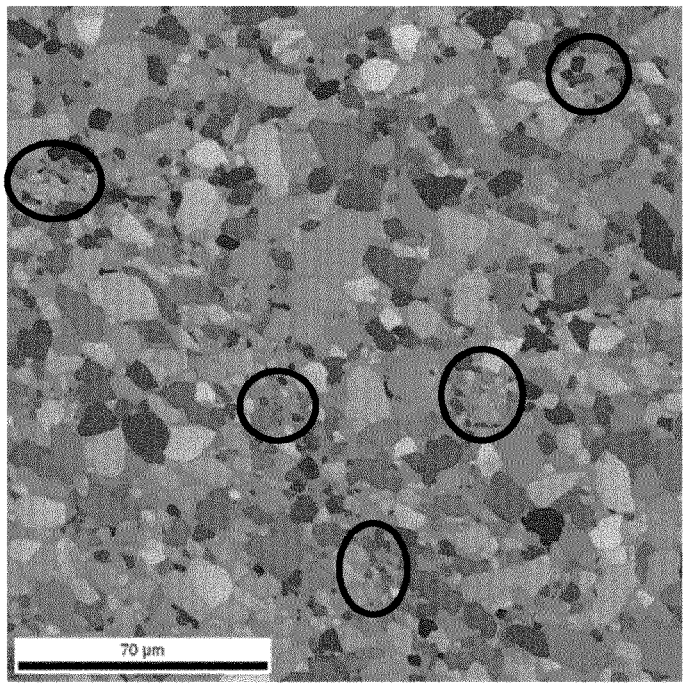
FIG. 5 is an EBSD micrograph showing a sintered cemented carbide prepared as A control sample described in Example 2.

A control batch of cemented carbides was made in exactly the same way as described above except that the ultra-coarse MAS2000 WC powder was not subjected to de-agglomeration and sifting prior to milling, pressing and sintering. The control batch was found to be much finer with WC mean grain size of 3.1 μm and contained 12.3% WC fraction finer than 1 μm. The microstructure of the control batch is shown in FIG. 5.

Table 3 shows the properties of the new cemented carbide with uniform microstructure in comparison with those of the control batch.

TABLE 3

| Property | Example 2 | Control batch |
|---|---|---|
| Density, g/cm$^3$, | 14.90 | 14.92 |
| TRS, MPa | 2,900 | 2,000 |
| Vickers hardness (HV30), GPa | 11.7 | 11.8 |
| Magnetic coercive force, kA/m, | 10.2 | 11.5 |
| Magnetic moment σ, μT m$^3$/kg | 0.69 | 1.67 |
| Wear rate, cm$^3$/revolution | $0.42 \times 10^{-4}$ | $0.40 \times 10^{-4}$ |
| Palmqvist fracture toughness, MPa m½. | 16.6 | 14.5 |

The control batch is characterized by nearly the same values of hardness and wear-resistance, and by significantly lower values of TRS and fracture toughness.

TEM and electron diffraction images of the binder material of both new cemented carbide and control batch indicated the presence of reflections from fcc Co and satellite reflections corresponding to the nanoparticles. The dark field TEM image of the binder material obtained using the satellite reflections indicated the presence of nanoparticles having size in the range from about 0.5 to about 7 nm. TEM and HRTEM images indicated that the nanoparticles have a size in the range from about 0.5 to about 7.5 nm. The mean grain size of the nanoparticles is measured by the linear intercept method and was found to be equal to 3.2 nm and the percentage of nanoparticles having size less than 3 nm was found to be 45 percent. The nanoparticles are believed to correspond to eta- ($Co_3W_3C$ or $Co_6W_6C$) or theta-phases ($Co_2W_4C$). Although the crystal lattice of these phases is very similar, the inter-lattice constant corresponded most closely to that of the theta-phase.

Figure 6:
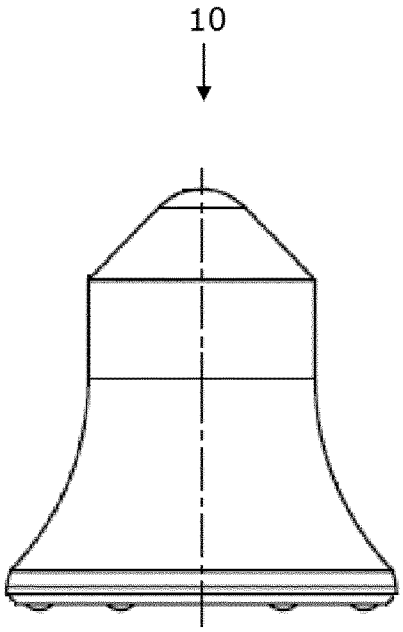
FIG. 6 is a side elevation view of an exemplary pick tool made using a cemented carbide prepared according to Example 2.

The cemented carbide may be used as part of a tool, such as a road or mining pick. FIG. 6 shows an exemplary pick tool 10. A number of road-planing picks with tips manufactured using the cemented carbide according to Example 2 were made and tested in asphalt-cutting and concrete-cutting. Picks tips of the same type and geometry as tips of the control batch were also tested using exactly the same conditions as a control.

In the first field test on deep milling of asphalt with depth of nearly 25 cm the picks with the tips of the Example 2 cemented carbide had 2.5% breakages, whereas those with the tips of the control batch had 9% breakages. The wear was nearly the same in the both cases.

In the second field test of deep milling of asphalt with depth of nearly 22 cm the picks with the tips of the Example 2 cemented carbide had 4% breakages, whereas those with the tips of the control batch had 13.5% breakages. The average wear of the picks with the new cemented carbide was about 7.0 mm, whereas that of the picks with the cemented carbide of the control batch was about 7.5 mm.

In the third field test of deep milling of concrete with depth of nearly 20 cm the picks with the tips of the Example 2 cemented carbide had 0% breakages, whereas those with the tips of the control batch had about 5% breakages. The average wear of the picks with the new cemented carbide was about 6.5 mm, whereas that of the picks with the cemented carbide of the control batch was about 8 mm.

Whilst not being bound by any specific theories, it is known that during operation of carbide tools (e.g. road-planing picks) under high impact loads and thermal shocks, cracks can form and propagate in carbide regions comprising a large proportion of fine-grain WC fraction. These regions consequently have a reduced fracture toughness. It is also known that the fracture toughness decreases with decreasing WC grain size. Therefore, by almost completely eliminating the carbide regions containing the fine grain WC fraction, which are shown in circles in FIG. 5 and consequently increasing the WC mean grain size, the fracture toughness increases. It has been surprisingly found that the increase in fracture toughness does not lead to a significant decrease of hardness and wear-resistance of ultra-coarse cemented carbides if the WC grains are rounded and the binder phase is reinforced by nanoparticles.

Various example embodiments of cemented carbides, methods for producing cemented carbides, and tools comprising cemented carbides have been described above. Those skilled in the art will understand that changes and modifications may be made to those examples without departing from the scope of the appended claims.

The invention claimed is:

1. Cemented carbide material comprising:

tungsten carbide grains, the content of tungsten carbide in the cemented carbide material being at least 75 weight percent and at most 95 weight percent; and a binder phase comprising any of cobalt, iron, or nickel, the binder phase further comprising nanoparticles particles, the nanoparticles comprising material according to the formula $Co_xW_yC_z$, where x is a value in the range from 1 to 7, y is a value in the range from 1 to 10 and z is a value in the range from 0 to 4, the nanoparticles having a mean grain size of no more than 10 nm and at least 10 percent of the nanoparticles having a size of at most 5 nm; and wherein the tungsten carbide mean grain size is 4±2 μm and wherein the volume percent of the tungsten carbide grains having a grain size of no more than 1 μm is less than 4 percent.

2. The cemented carbide material as claimed in claim 1, wherein the volume percentage of tungsten carbide grains larger than 8 μm is below 10 percent.

3. The cemented carbide material as claimed in claim 1, in which the binder material further comprises at least 10 weight percent tungsten.

4. The cemented carbide material as claimed in claim 1, having a cobalt content between 5 and 8 weight percent, and wherein the cemented carbide material has a magnetic coercive force Hc in kA/m of at least Hc=−1.9D+12, where the D value is circle equivalent diameter in microns and obtained by a circle equivalent diameter method on the basis of EBSD mapping images.

5. The cemented carbide material as claimed in claim 1, having a cobalt content between 8 and 12 weight percent and wherein the cemented carbide material has a magnetic coercive force Hc in kA/m of at least Hc=−2.1D+12, where the D value is circle equivalent diameter in microns and obtained by a circle equivalent diameter method on the basis of EBSD mapping images.

6. The cemented carbide material as claimed in claim 1, in which the cemented carbide material has a magnetic coercive force Hc in UA/m of at least 1.1×(100×[Co])−1.2/D+3.3, where D is in microns, and [Co] is the weight percent of cobalt in the cemented carbide material.

7. The cemented carbide material as claimed in claim 1, in which the cemented carbide material has a magnetic coercive force Hc in UA/m of at least 1.1×(200×[Co])−1.2/D+3.3, where D is in microns, and [Co] is the weight percent of cobalt in the cemented carbide material.

8. The cemented carbide material as claimed in claim 1, comprising at least 0.1 weight percent to 10 weight percent of any of vanadium, chromium, tantalum, titanium, molybdenum, niobium and hafnium.

9. A method of making a cemented carbide body, the method comprising:

providing a de-agglomerated tungsten carbide powder in which less than 4 volume percent of tungsten carbide has a grain size of less than 1 μm;

milling the tungsten carbide powder and a binder precursor powder together;

pressing the milled powders to form a green body; sintering the green body to form a sintered body comprising tungsten carbide and a binder phase; and heat treating the sintered body at a temperature in a range of 500° C. to 900° C. for a period of time; the period in hours being at least (0.8×D)−0.15 and at most (4.3×D)−1.7, where D is the mean size of tungsten carbide in microns;

wherein the sintered body comprises less than 4 volume percent of tungsten carbide having a grain size less than 1 μm;

thereby producing the cemented carbide material of claim 1.

10. The method as claimed in claim 9, in which the binder phase comprises at least 10 weight percent tungsten.

11. The method as claimed in claim 1, in which the tungsten is present in the binder phase in the form of solid solution or dispersed particles comprising a compound according to the formula $Co_xW_yC_z$, where x is a value in the range from 1 to 7, y is a value in the range from 1 to 10 and z is a value in the range from 1 to 4.

12. The method as claimed in claim 9, in which the binder phase comprises any of iron or nickel.

13. The method as claimed in claim 9, in which the composition and microstructure of the sintered body is selected such that magnetic moment (or magnetic saturation) of the sintered body is at least 70 percent and at most 85 percent of the theoretical value of binder material comprising nominally pure Co or of the alloy of Co and Ni comprised in the binder material.

14. The method as claimed in claim 9, further comprising de-agglomerating tungsten carbide powder and sifting the tungsten carbide to provide a tungsten carbide powder in which less than 4 volume percent of tungsten carbide has a grain size of less than 1 μm.

15. A tool comprising cemented carbide material as claimed in claim 1.

16. A tool as claimed in claim 15, being any of a pick for road-planing and a pick for mining.

* * * * *